US005224729A

United States Patent [19]

Provence et al.

[11] Patent Number: 5,224,729

[45] Date of Patent: Jul. 6, 1993

[54] CROSS-COUNTRY SKI BINDING

[75] Inventors: Marc Provence, Thorens les Glieres; Gerard Graillat, Annecy, both of France

[73] Assignee: Salomon S.A., Annecy Cedex, France

[21] Appl. No.: 774,062

[22] Filed: Oct. 9, 1991

Related U.S. Application Data

[63] Continuation of Ser. No. 377,555, Jul. 10, 1989, Pat. No. 5,085,454.

[30] Foreign Application Priority Data

Jul. 13, 1988 [FR] France ..... 88 09983

[51] Int. Cl.[5] ..... A63C 9/18

[52] U.S. Cl. ..... 280/615; 280/634

[58] Field of Search ..... 280/607, 614, 615, 623, 280/626, 631, 632, 633, 634, 11.14

[56] References Cited

U.S. PATENT DOCUMENTS

| | | | |
|---|---|---|---|
| 2,590,424 | 3/1952 | Lehmkuhl | 280/615 |
| 2,758,846 | 8/1956 | Swensen | 280/615 |
| 4,239,257 | 12/1980 | Biermann et al. | 280/615 |
| 4,322,091 | 3/1982 | Storandt | 280/615 |
| 4,484,762 | 11/1984 | Salomon | 280/615 |
| 4,533,154 | 8/1985 | Bernard et al. | 280/615 |
| 4,659,103 | 4/1987 | Tessaro | 280/615 |
| 4,768,804 | 9/1988 | With | 280/614 |
| 4,787,155 | 11/1988 | Callegari | 280/615 X |
| 4,887,832 | 12/1989 | Provence | 280/615 |
| 4,925,206 | 5/1990 | Graillat | 280/615 |
| 4,927,168 | 5/1990 | Provence et al. | 280/615 |
| 4,949,988 | 8/1990 | Rousset et al. | 280/615 |
| 4,959,913 | 10/1990 | Provence et al. | 36/117 |
| 4,998,746 | 3/1991 | Arnulf | 280/615 |
| 5,007,656 | 4/1991 | Girault et al. | 280/615 |
| 5,052,710 | 10/1991 | Provence et al. | 280/615 |
| 5,085,454 | 2/1992 | Provence et al. | 280/615 |
| 5,087,065 | 2/1992 | Provence et al. | 280/615 |

FOREIGN PATENT DOCUMENTS

| | | | |
|---|---|---|---|
| 0131234 | 1/1985 | European Pat. Off. | |
| 0217264 | 4/1987 | European Pat. Off. | 280/615 |
| 2943715 | 5/1981 | Fed. Rep. of Germany | |
| 2582226 | 11/1986 | France | |
| 110127 | 5/1925 | Switzerland | |
| 156480 | 10/1932 | Switzerland | |
| 278973 | 2/1952 | Switzerland | |
| 8400498 | 2/1984 | World Int. Prop. O. | |

*Primary Examiner*—Brian Johnson

*Attorney, Agent, or Firm*—Sandler Greenblum & Bernstein

[57] ABSTRACT

A binding for a cross-country ski shoe in which the shoe is mounted for pivotal movement about an axis transverse to the longitudinal axis of the ski. An elastic bumper exerts a return force on the shoe when the shoe is lifted from the upper surface of the ski. The elastic bumper is brought into a prestressed condition during the closing of the binding. The prestressing is achieved by either the displacement of the shoe with respect to the elastic bumper or displacement of the elastic bumper with respect to the shoe. This displacement may either be slidable or pivotal movement of a carriage.

8 Claims, 3 Drawing Sheets

CROSS-COUNTRY SKI BINDING

This application is a continuation of application Ser. No. 07/377,555, filed Jul. 10, 1989, now U.S. Pat. No. 5,085,454.

BACKGROUND OF THE INVENTION

1. Field of the Invention

The present invention relates to a cross-country ski binding that journals a shoe on the ski for movement about an axis transverse to the longitudinal axis of the ski and also includes an elastic element adapted to exert a return force on the shoe when it is lifted from an upper surface of the ski as it pivots about a journal axis.

2. Description of Background and Relevant Information

In such a binding, the elastic elements are each generally constituted by a bumper of elastic material positioned so as to face a corresponding support surface of the nose of the shoe when the binding is closed.

The elastic bumper is compressed by the nose of the shoe during its pivoting and can then exert a return force thereon.

So as to permit easy insertion into the binding, a certain play is necessary between the associated support surfaces of the elastic bumper and the shoe. This play, which varies with respect to factory tolerances and the wear and tear of the elastic bumper, is detrimental to good control of the ski.

An object of the present invention is to overcome these disadvantages and to provide a binding of the type described above in which it is possible to eliminate the play between the associated support surfaces of the elastic element and the shoe, while still allowing easy insertion of the shoe into the binding.

SUMMARY OF THE INVENTION

The present invention relates to a binding for a cross-country ski shoe, of the type having journal means for movement of the shoe about an axis transverse to the longitudinal axis of the ski and elastic means adapted to exert a return force on the shoe when the shoe is lifted from the upper surface of the ski by pivoting around its journal axis. The binding includes means for bringing the elastic means into a prestressed condition against the nose of the shoe during the closing of the binding. The prestressing of the elastic means is achieved by relative displacement of the elastic means and the nose of the shoe during closure of the binding.

According to another aspect of the invention, the journal means of the shoe include a locking system with jaws adapted to encompass the journal axle of the shoe. The locking system includes a fixed jaw and a movable jaw. The movable jaw may be pivotably or slidably mounted.

According to another aspect of the invention, the prestressing is achieved by displacement of the shoe with respect to the elastic means, or by displacement of the elastic means with respect to the shoe.

The elastic means is carried by the movable jaw and may be a bumper formed from elastic material. The elastic bumper is positioned at a predetermined distance from an associated support surface of the shoe when the shoe is placed in the open binding. The distance of the elastic bumper to the associated support surface of the shoe is less than the distance of movement of the movable jaw.

According to the invention, a binding for a cross-country ski shoe includes a journal axis for movement of the shoe about an axis transverse to the longitudinal axis of a ski, an elastic element for exerting a return force on the nose of the shoe when the shoe is lifted from the upper surface of the ski by pivoting around its journal axle, and means for moving the journal axle towards and away from the elastic element, whereby the elastic element is brought into a prestressed condition against the nose of the shoe during closing of the binding. The means for moving the journal axle includes a base adapted to be mounted on the ski and a movable carriage mounted for movement relative to the base. A locking system adapted to receive the journal axle includes a fixed jaw mounted on the base and a movable jaw mounted on the movable carriage. The fixed jaw and the movable jaw are adapted to receive the journal axle. The fixed jaw is an element part extending upwardly from the base and the movable jaw is formed in the shape of a reversed C.

According to a first embodiment, the movable carriage is mounted for sliding movement on the base. A lever mounted on the base cooperates with the movable carriage to control movement of the movable carriage. A part extends from the carriage and the lever is pivotally mounted on the base and includes means for cooperation with the part. The part extends upwardly and includes a loop-shaped portion and the lever includes an axle for cooperation with the loop-shaped portion.

According to another aspect of the invention, the elastic element is positioned at a predetermined distance from the nose of the shoe when the shoe is placed in the open binding. The predetermined distance is less than the distance of movement of the movable carriage.

In another embodiment of the invention, a binding for a cross-country ski shoe includes a journal axle for the shoe for movement about an axis transverse to the longitudinal axis of a ski, an elastic element for exerting a return force on the nose of the shoe when the shoe is lifted from the upper surface of the ski by pivoting around its journal axle, and means for mounting the elastic element for movement towards and away from the nose of the shoe, whereby the elastic element is brought into a prestressed condition against the nose of the shoe during closing of the binding. The means for mounting the elastic element includes a base adapted to be mounted on the ski and a movable carriage mounted for movement relative to the base. The elastic element is mounted on the movable carriage and includes a locking system adapted to receive the journal axle of the shoe.

The locking system includes a fixed jaw mounted on the base and a movable jaw mounted on the movable carriage. The fixed jaw and the movable jaw are adapted to receive the journal axle of the shoe. The fixed jaw is an element extending upwardly relative to the base and the movable jaw is formed in the shape of a C.

The movable carriage is mounted for sliding movement on the base and includes a lever mounted on the base that cooperates with the movable carriage to control movement of the movable carriage. A part extends from the carriage and the lever is pivotally mounted on the base and includes means for cooperating with the part. The part extends upwardly and includes a loop-shaped portion and the lever includes an axle for cooperation with the loop-shaped portion.

The elastic element is positioned at a predetermined distance from the nose of the shoe when the shoe is placed in the open binding and the predetermined distance is less than the distance of movement of the movable carriage.

According to a third embodiment, the movable carriage is mounted for pivotal movement on the base. The movable carriage is biased for pivotal movement to the open binding position. A latching element locks the movable carriage in the closed binding position and includes a control lever which is adapted to be activated by the point of a ski pole.

BRIEF DESCRIPTION OF THE DRAWINGS

The invention is further explained in the description which follows with reference to the drawings illustrating, by way of non-limiting examples, two preferred embodiments of the invention wherein.

DETAILED DESCRIPTION OF THE PREFERRED EMBODIMENTS

According to the present invention, the elastic element is brought into a prestressed state against the nose of the shoe during closure of the binding. The prestressing of the elastic element makes it possible to eliminate any play between the binding and the shoe and thus makes it possible to provide good control of the ski by the skier.

According to a preferred embodiment, the prestressing of the elastic element is achieved by relative displacement of the elastic element and the nose of the shoe during closure of the binding. It is possible to facilitate the insertion of the shoe since the plastic element is only brought into a prestressed condition against the nose of the shoe at the moment of the closing of the binding, and thus does not hinder the introduction of the shoe therein.

The prestressing of the elastic element can either be achieved by displacement of the shoe with respect to the elastic element or by displacement of the elastic element with respect to the shoe.

Figure 1:
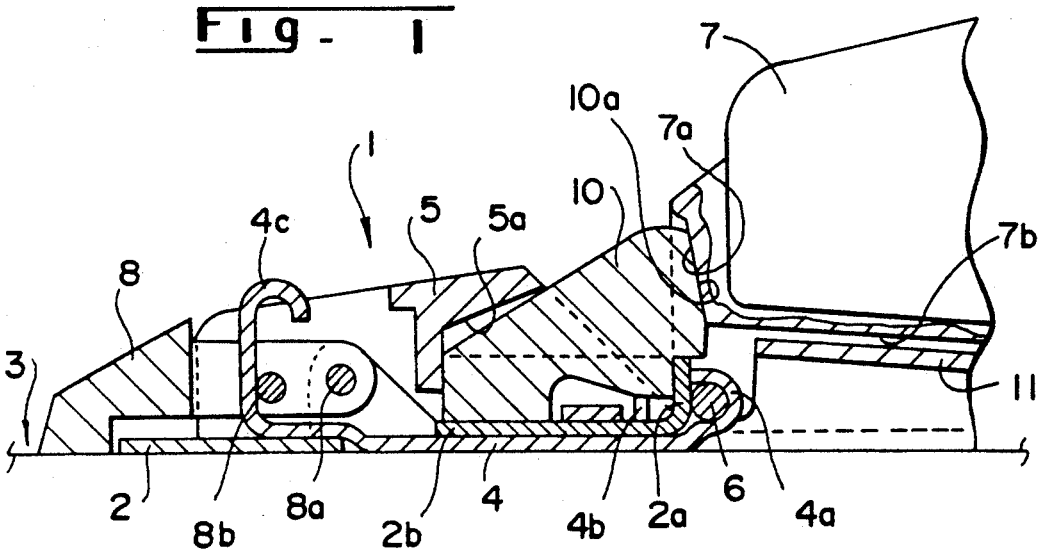
FIG. 1 is a longitudinal sectional view of a binding in the closed position, according to a first embodiment.
Figure 2:
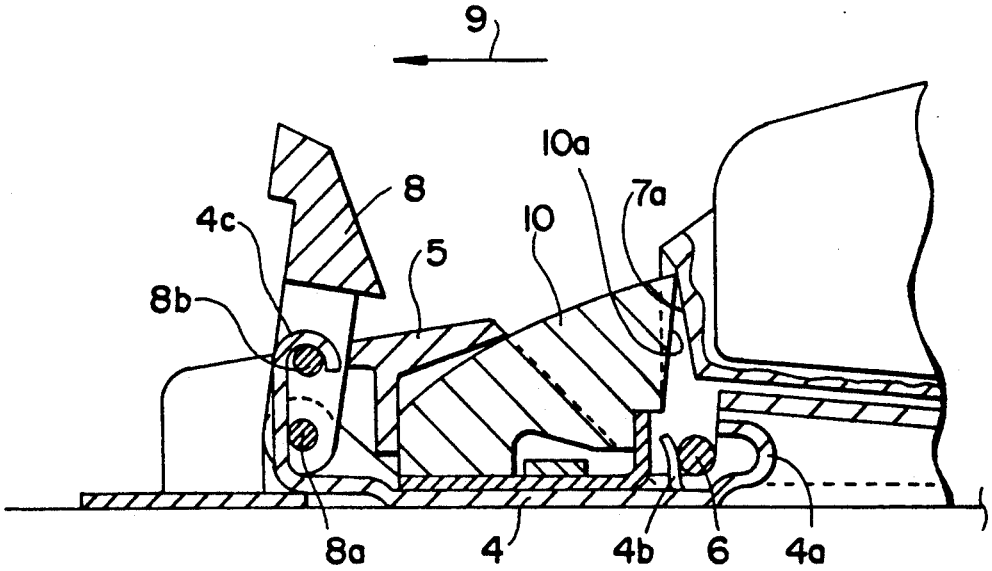
FIG. 2 is a view similar to FIG. 1 showing the binding in the open position.

Binding 1 shown in FIGS. 1 and 2 is essentially constructed of a base 2 fixed on the upper surface of ski 3 by known means such as glue, screws, etc. A movable carriage 4 is mounted for movement with respect to base 2 and a protective cuff 5 is solidly affixed to base 2.

The locking system of the binding is constituted by a fixed jaw 2*a*, formed by a part raised from base 2, and movable jaw 4*a*, formed by a part of the movable carriage 4 and having the shape of a reversed C.

Movable jaw 4*a* is located at the rear of the fixed jaw 2*a* and is capable of moving towards the latter in the direction of arrow 9, to encompass an axle 6 of a shoe 7, thereby forming a hinged journal around which shoe 7 can pivot. The journalling axle 6 is fixed at the front of the shoe 7 in a known manner, and extends substantially perpendicular to the longitudinal axis of ski 3.

Carriage 4 is slidably mounted for movement in the longitudinal direction of the ski and is guided laterally by a slide 2*b* formed on each side of base 2.

Displacement of carriage 4 is controlled by a lever 8 pivotally mounted at 8*a* on base 2 and includes a transverse axle 8*b* cooperating with a loop-shaped part 4*c* of the carriage.

As can be seen from FIGS. 1 and 2, displacement of carriage 4 in the direction of closing, i.e. in the direction indicated by arrow 9, is achieved, from the open position shown in FIG. 2, by rotation of the lever 8 in the counter-clockwise direction around its axle 8*a*, the axle 8*b* thereby moving the loop 4*c* of the carriage in the direction of arrow 9.

The locking of shoe 7 in the binding is achieved in the following manner.

First, the shoe is positioned in the open device so that its axle 6 is in front of the movable jaw 4*a* (see FIG. 2). By activating the lever 8, as previously described, carriage 4 is displaced in the direction of arrow 9. Simultaneously, movable jaw 4*a* of the carriage moves the axle of rotation 6 of the shoe in this same direction and presses it against the fixed jaw 2*a*, thus achieving the locking of the journal axle 6 (see FIG. 1).

Carriage 4 includes two lateral tongues 4*b* in front of jaw 4*a*. The two lateral tongues 4*b* are substantially vertical and are adapted to bring shoe 7 back towards the rear during the opening of the binding.

Finally, the binding includes a bumper 10 of elastic material that is retained in housing 5*a* of protective cuff 5. Bumper 10 includes a rear surface 10*a* forming a support surface which is adapted to cooperate with an associated support surface 7*a* provided on the front end of the nose of the shoe 7. The bumper exerts a return force on the shoe when it is lifted from the upper surface of the ski by pivoting around its journal axle 6.

As shown in FIGS. 1 and 2, elastic bumper 10 is formed and arranged so that its support surface 10*a* is at a predetermined distance from the associated support surface 7*a* of the shoe when the latter is placed in the open binding. Thus, the elastic bumper 10 does not hinder the positioning of the shoe in the binding since it is not in contact therewith.

Elastic bumper 10, which projects towards the rear, i.e. towards the right in the drawings, with respect to the movable carriage 4, is arranged so that the distance of displacement of the movable carriage 4 is greater than the distance between the associated support surfaces 10*a* and 7*a*, respectively, of the bumper and the shoe in the open position of the binding. As a result, the elastic bumper 10 is compressed by the surface 7*a* of the shoe during the displacement thereof towards the front (in the direction of arrow 9) at the moment of the closing of the binding (see FIG. 1). The bumper is therefore prestressed against the support surface 7*a* of the shoe at the moment of the closing of the binding. Consequently, any play between the shoe and the binding is eliminated even when the shoe rests flat on the ski, and therefore the skier has better control of the ski.

Moreover, the prestressing of the elastic bumper 10 guarantees that it comes into play from the beginning of the detachment of the heel of the shoe from the ski during cross-country skiing, therefore eliminating any "wobbling" with respect to guidance at the beginning of the skier's movement.

Finally, it is noted that the binding includes a guidance rib 11 cooperating with a groove 7*b* of complimentary shape on the shoe 7 for the lateral guidance of the shoe during cross-country skiing.

Figure 3:
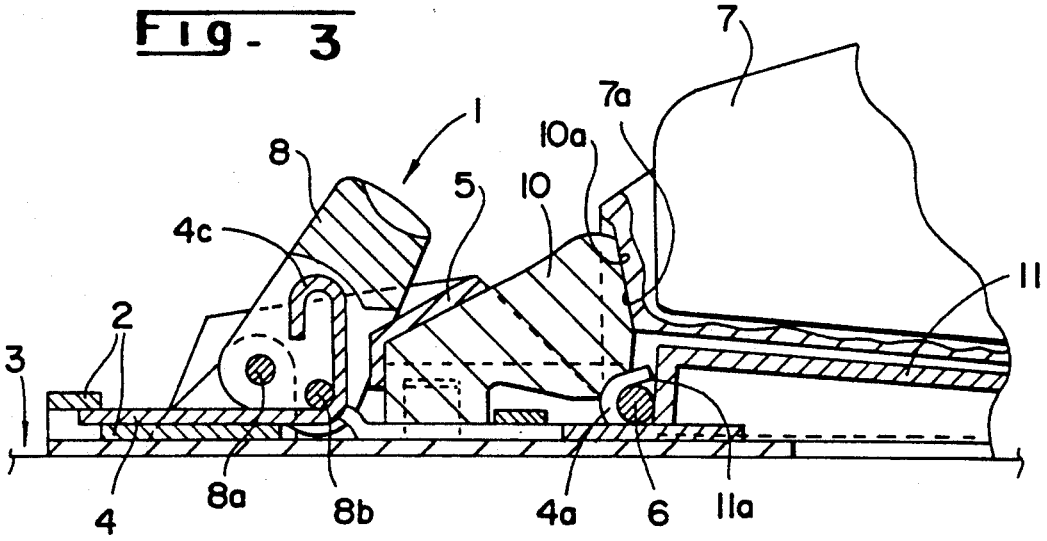
FIGS. 3 and 4 are views similar to FIGS. 1 and 2, respectively, of a binding according to a second embodiment.
Figure 4:
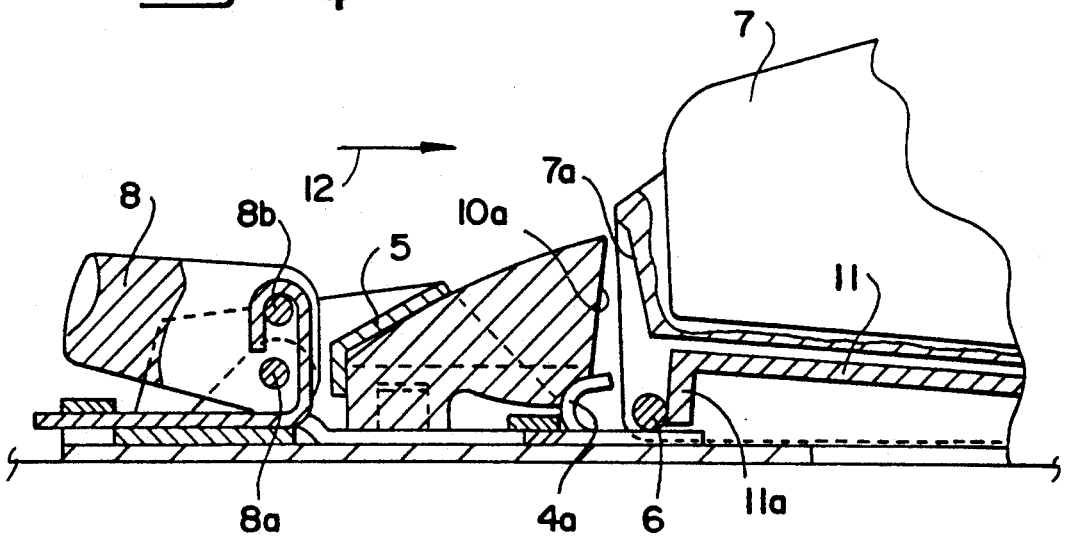

FIGS. 3 and 4 show another embodiment of a binding according to the present invention for which similar elements will be designated by the same references numbers.

This binding includes, as in the binding previously described, a base 2 fixed on ski 3, and forming a slide for movable carriage 4, which is activated by lever 8, and elastic bumper 10 protected by cuff 5.

In this embodiment, the fixed jaw 11*a* is constituted by a frontal wall of the guidance rib, whereas the movable jaw 4*a* is formed by a part of the movable carriage and is substantially C-shaped, and is situated in front of fixed jaw 11*a*. Alternatively, the fixed jaw could be constituted by any other fixed part of the binding.

In this embodiment, movable jaw 4*a* is displaceable in the direction of the fixed jaw 11*a* (in the direction of arrow 12, i.e., in the direction of the rear of the ski).

The displacement of carriage 4 for closure of the binding is thus controlled in the same manner as previously described by a lever 8. However, pivoting of the lever is in the clockwise direction around its rotation axle 8*a*.

Contrary to the binding of FIGS. 1 and 2, the elastic bumper 10, as well as the protective cuff 5, are solidly affixed to carriage 4, and are thus displaceable therewith.

In the embodiment of FIGS. 3 and 4, the prestressing of the elastic bumper 10, during the closing of the binding will thus be achieved, not by displacement of the shoe 7, but by displacement of the bumper 10 against the shoe. The bumper is compressed against the associated support surface 7*a* of the shoe in the course of this displacement. Of course, as in the embodiment of FIGS. 1 and 2, the bumper 10 is positioned so that its support surface 10*a* is at a distance from the associated support surface 7*a* of the shoe in the open position of the binding which is less than the distance of displacement of movable carriage 4.

The positioning of the shoe is carried out in the same manner as previously described. Bumper 10 is at a distance from the support surface of the shoe in the open position of the binding and does not hinder insertion of the shoe. Likewise, locking is achieved by simple pivoting of lever 8 in the clockwise direction, as previously indicated.

It will also be noted that the embodiment of FIGS. 3 and 4 makes it possible to obtain the same advantages as the first embodiment, namely the elimination of any play between the binding and shoe and better control of the ski.

Figure 5:
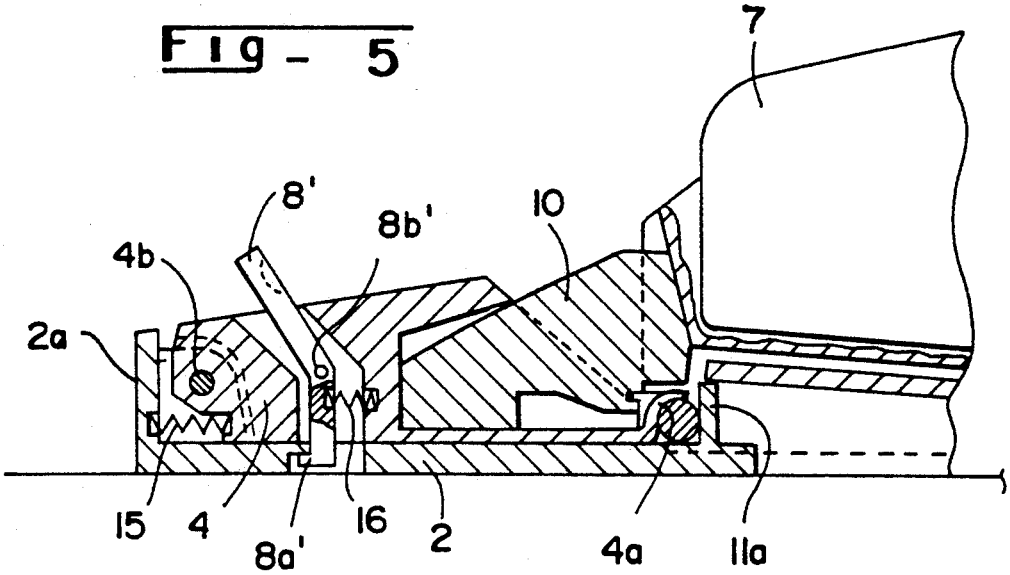
FIGS. 5 and 6 are views similar to FIGS. 1 and 2, respectively, of a binding according to a third embodiment.
Figure 6:
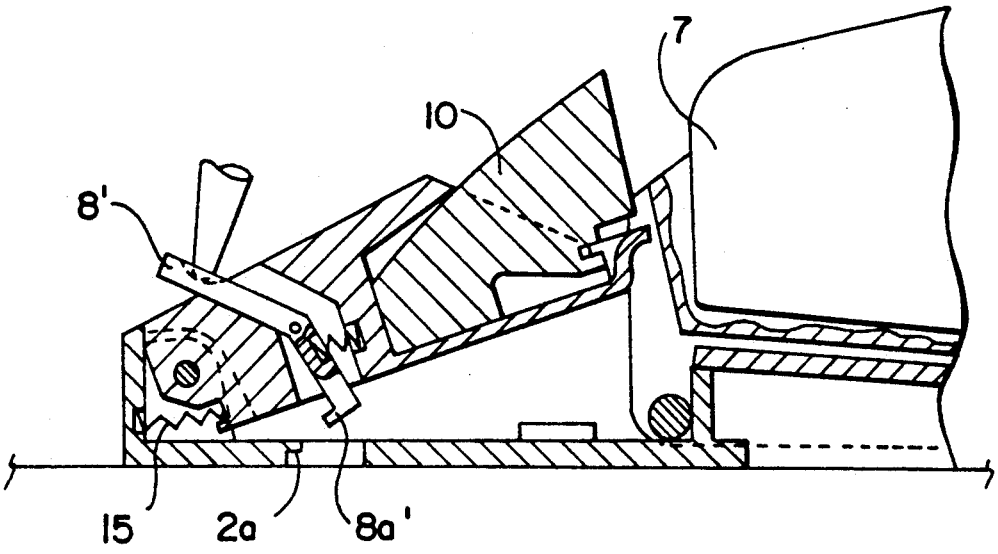

FIGS. 5 and 6 show an embodiment similar to that of FIGS. 3 and 4 in which similar elements are designated by the same reference numbers. The locking of the journal axis 6 of the shoe is activated by rotation of the movable jaw 4*a*.

In this embodiment, movable carriage 4 which supports jaw 4*a* is pivotally mounted on an axle 4*b* and is biased for rotation in the counterclockwise direction for unlocking by a spring 15 which is inserted between carriage 4 and a part 2*a* attached to base 2.

The locking of the binding occurs by pivoting of the movable carriage 4 in the clockwise direction and locking it by means of a latching element 8*a*′ which cooperates projection 2*a* on base 2.

The latching element 8*a*′ is located at one end of control lever 8′ which is used for locking the binding. Lever 8′ is pivotally mounted at 8*b*′ on carriage 4 and can be activated by the point of a ski pole as shown in FIG. 6 for unlatching the binding.

Of course, the present invention is not limited only to the embodiments shown here by way of non-limiting examples, but includes all embodiments implementing similar or equivalent means.

The present invention is not limited to the type of binding shown but can likewise be used with other types of bindings.

We claim:

1. A binding for a cross-country ski shoe, the shoe comprising a nose and a journal axle for movement of the shoe about an axis transverse to the longitudinal axis of a ski, said binding being movable between an open and closed position, said binding comprising:

(a) an elastic element connected to a portion of the binding adjacent the nose of the shoe for exerting a return force on the nose of the shoe when the shoe is lifted from an upper surface of the ski by pivoting around said journal axle, said elastic element having an uncompressed volume;

(b) means for moving said journal axle towards and away from said elastic element, said means for moving said journal axle including a base adapted to be mounted on the ski and a movable carriage mounted for movement relative to said base and engagement with said journal axle for moving said journal axle, whereby said elastic element is brought into compression against the nose of the shoe during closing of the binding; and (c) said means for moving said journal axis further including a locking system adapted to receive said journal axle, said locking system including a fixed jaw mounted on said base and a movable jaw mounted on said movable carriage, said fixed jaw and said movable jaw being adapted to receive said journal axle.

2. The binding according to claim 1, wherein said fixed jaw is an element extending upwardly from said base.

3. The binding according to claim 1, wherein said movable jaw is formed in the shape of a reversed C.

4. A binding for a cross-country ski shoe, the shoe comprising a nose and a journal axle for movement of the shoe about an axis transverse to the longitudinal axis of a ski, said binding including means for movement between an open and closed position, said binding comprising:

(a) an elastic element connected to a portion of the binding adjacent the nose of the shoe for exerting a return force on the nose of the shoe when the shoe is lifted from an upper surface of the ski by pivoting around said journal axle, said elastic element having an uncompressed volume;

(b) means for moving said journal axle towards and away from said elastic element, said means for moving said journal axle including a base adapted to be mounted on the ski and a movable carriage mounted for sliding movement on said base and engagement with said journal axle for moving said journal axle, whereby said elastic element is brought into compression against the nose of the shoe during closing of the binding.

5. The binding according to claim 4, further comprising a lever mounted on said base and cooperating with said movable carriage to control movement of said movable carriage.

6. The binding according to claim 5, further comprising a part extending from said movable carriage, said lever being pivotally mounted on said base.

7. The binding according to claim 6, wherein said part extends upwardly and includes a loop-shaped portion and said lever includes an axle for cooperation with said loop-shaped portion.

8. The binding according to claim 4, wherein said elastic element is positioned at a predetermined distance from the nose of the shoe when the shoe is placed in the open binding, said predetermined distance being less than a distance of movement of said movable carriage.

* * * * *